US012735905B2

(12) United States Patent
Brinkmann

(10) Patent No.: US 12,735,905 B2
(45) Date of Patent: Sep. 15, 2026

(54) ANTI-LIFT SYSTEM, FLOOR PART, SCAFFOLD, AND USE

(71) Applicant: Scafom Holding B.V., Budel (NL)

(72) Inventor: Franciscus Jozef Leonardus Hubertus Brinkmann, Lierop (NL)

(73) Assignee: Scafom Holding B.V., Budel (NL)

( * ) Notice: Subject to any disclaimer, the term of this patent is extended or adjusted under 35 U.S.C. 154(b) by 0 days.

(21) Appl. No.: 19/116,492

(22) PCT Filed: Sep. 29, 2023

(86) PCT No.: PCT/NL2023/050510
§ 371 (c)(1),
(2) Date: Mar. 28, 2025

(87) PCT Pub. No.: WO2024/072222
PCT Pub. Date: Apr. 4, 2024

(65) Prior Publication Data

US 2025/0257578 A1 Aug. 14, 2025

(30) Foreign Application Priority Data

Sep. 30, 2022 (NL) ..... 2033195

(51) Int. Cl.
*E04G 1/15* (2006.01)
*E04G 5/08* (2006.01)
*E04G 7/30* (2006.01)

(52) U.S. Cl.
CPC ..... *E04G 1/154* (2013.01); *E04G 5/08* (2013.01); *E04G 7/305* (2013.01)

(58) Field of Classification Search
CPC ..... E04G 1/154; E04G 5/08; E04G 7/305
See application file for complete search history.

(56) References Cited

U.S. PATENT DOCUMENTS 3,373,465 A * 3/1968 Johnson ..... E04G 7/305 24/490
2010/0326771 A1* 12/2010 Kreller ..... E04G 1/154 182/222

FOREIGN PATENT DOCUMENTS

CN 101597955 A 12/2009
CN 103410304 A 11/2013
(Continued)

OTHER PUBLICATIONS

International Search Report and Written Opinion—PCT/NL2023/050510—mailing date Dec. 18, 2023.

*Primary Examiner* — Brian D Mattei
*Assistant Examiner* — Kathleen M. McFarland
(74) *Attorney, Agent, or Firm* — Banner & Witcoff, Ltd.

(57) ABSTRACT

Anti-lift system for a floor part for a scaffold, comprising: an end piece provided with one or more hook elements with which the floor part can be hooked to a transverse ledger of the scaffold so as to be supported on that transverse ledger, wherein the hook elements define a ledger receiving space for the transverse ledger; and a stiff bolt couplable with the end piece, which in coupled condition is movable relative to the end piece along a bolt movement path between a releasing position and a locking position, wherein the bolt in the locking position extends along the ledger receiving space to block movement of a received transverse ledger out of the ledger receiving space, wherein the bolt in the releasing position extends less or not along the ledger receiving space to release movement of the received transverse ledger out of the ledger receiving space. The system is configured to have the bolt automatically move to the locking position when the bolt is between the locking position and the releasing position. A resistance element can stabilize the releasing position.

18 Claims, 7 Drawing Sheets

(56) References Cited

FOREIGN PATENT DOCUMENTS

| | | | | | |
|---|---|---|---|---|---|
| CN | 106715810 | A | | 5/2017 | |
| CN | 111344465 | A | | 6/2020 | |
| DE | 2640976 | A1 | | 3/1978 | |
| EP | 0637660 | A1 | | 2/1995 | |
| EP | 1039067 | A1 | * | 9/2000 | ..... E04G 7/28 |
| FR | 1432637 | A | * | 3/1966 | ..... E04G 7/305 |
| FR | 1496014 | A | * | 9/1967 | ..... E04G 7/305 |
| FR | 2083214 | A1 | * | 3/1971 | |
| FR | 2781534 | A1 | | 1/2000 | |
| GB | 1504748 | A | | 3/1978 | |
| GB | 2127086 | A | | 4/1984 | |
| GB | 2174747 | A | * | 11/1986 | ..... F16B 45/026 |
| JP | H0941658 | A | | 2/1997 | |
| JP | 2008008052 | A | | 1/2008 | |

* cited by examiner

ANTI-LIFT SYSTEM, FLOOR PART, SCAFFOLD, AND USE

CROSS-REFERENCE TO RELATED APPLICATIONS

This application is a U.S. National Stage application under 35 U.S.C. § 371 of International Application PCT/NL2023/050510 (published as WO 2024/072222 A1), filed Sep. 29, 2023, which claims the benefit of priority to Application NL 2033195, filed Sep. 30, 2022. Benefit of the filing date of these prior applications is hereby claimed. Each of these prior applications is hereby incorporated by reference in its entirety.

FIELD

The invention relates to an anti-lift system for a floor part for a scaffold, as well as to a floor part provided with such an anti-lift system, a scaffold provided with such a floor part, and a use.

BACKGROUND

Anti-lift systems for a floor part for a scaffold are known in various forms, for example from WO00/61891A1, GB2127086A and FR2781534A1. An anti-lift system is generally configured to counteract a floor part getting unintentionally detached from a scaffold, in particular due to an upward force of wind to which the floor part is exposed.

There is an ongoing need for further improvement of such systems, it being desired in particular that reliable anti-lift protection is combined with a high measure of ease of use and durability.

SUMMARY

An object of the invention is to improve anti-lift protection for a floor part for a scaffold, in particular as regards reliability of the protection, ease of use, and/or durability. An object is to at least partly remedy one or more disadvantages of known systems, in particular while retaining advantages presented. An object is to provide at least an alternative anti-lift system.

To this end, according to an aspect, an anti-lift system according to claim 1 for a floor part for a scaffold is provided. The anti-lift system, herein also referred to as 'system' for short, comprises an end piece configured to form a longitudinal end of a floor part for a scaffold, provided with one or more hook elements with which the floor part at the longitudinal end can be hooked to a transverse ledger of the scaffold so as to be supported on that transverse ledger. The hook elements define a ledger receiving space for the transverse ledger. The transverse ledger is received in the ledger receiving space when the floor part is hooked to the transverse ledger with the hook elements. Such hook elements are known per se for floor parts for scaffolds.

The system comprises a stiff bolt couplable with the end piece, which in coupled condition is movable relative to the end piece along a bolt movement path between a releasing position and a locking position. In the locking position, the bolt extends along the ledger receiving space to block movement of a received transverse ledger out of the ledger receiving space. In the releasing position, the bolt extends less or not along the ledger receiving space to release movement of the received transverse ledger out of the ledger receiving space.

The anti-lift system is configured to have the bolt in coupled condition automatically move to the locking position when the bolt is between the locking position and the releasing position, at least when the transverse ledger is received in the ledger receiving space.

Having the bolt thus move automatically to the locking position can counteract the bolt remaining unintentionally and/or unnoticed in an intermediate position between the locking position and the releasing position when the transverse ledger is received in the ledger receiving space. Such an intermediate position could otherwise result in insufficient or at least reduced anti-lift protection. A further advantage is that a user, in this way, needs to displace the bolt from its releasing position only a little at the most, to have the bolt reach the locking position.

Having the bolt automatically move to the locking position can be driven in various ways, for instance through a bias toward the locking position. In a particularly robust embodiment, having the bolt automatically move to the locking position is driven by the bolt's own weight, as is further explained in the detailed description.

A further aspect provides a floor part for a scaffold, provided with at least one anti-lift system as herein described, with the end piece of each anti-lift system forming a respective longitudinal end of the floor part.

A further aspect provides a scaffold provided with a floor part as herein described, wherein the floor part at the longitudinal end is hooked with the hook elements to a respective transverse ledger of the scaffold so that the transverse ledger is received in the ledger receiving space.

With such a floor part and such a scaffold the above-mentioned advantages can be achieved.

A further aspect provides a use of an anti-lift system as herein described for anti-lift protection of a floor part which at a longitudinal end of the floor part is hooked with hook elements to a transverse ledger of a scaffold, so that the transverse ledger is received in the ledger receiving space, wherein the bolt is coupled with the end piece and is automatically moved to the locking position when the bolt is between the locking position and the releasing position.

Such a use provides above-mentioned advantages.

Optional further advantageous elaborations of the invention are provided by the features of the dependent claims, as is further explained in the detailed description given hereinbelow.

DETAILED DESCRIPTION

In the following, the invention will be further explained on the basis of examples of embodiments and drawings. The drawings are schematic and show only examples. In the drawings, corresponding elements are indicated with corresponding reference signs. In the drawings:

FIG. 1 shows a cutaway front view of a scaffold with floor parts with anti-lift systems;

FIGS. 2A-B each show a cutaway front view of an anti-lift system with the bolt in coupled condition, where the bolt in FIG. 2A is in the locking position and in FIG. 2B in the releasing position;

FIGS. 3A-B each show a perspective view of the system of FIGS. 2A-B with the bolt in corresponding positions;

FIGS. 4A-B each show a further perspective view of the system of FIGS. 2A-B with the bolt in corresponding positions;

FIGS. 5A-F each show a cutaway front view of the system of FIGS. 2A-B, with different successive positions of the bolt and the transverse ledger when the transverse ledger is moved into the ledger receiving space;

FIGS. 6A-B each show a cutaway front view of the system of FIGS. 2A-B, with different successive positions of the bolt when the bolt is coupled to the end piece;

Figure 1:
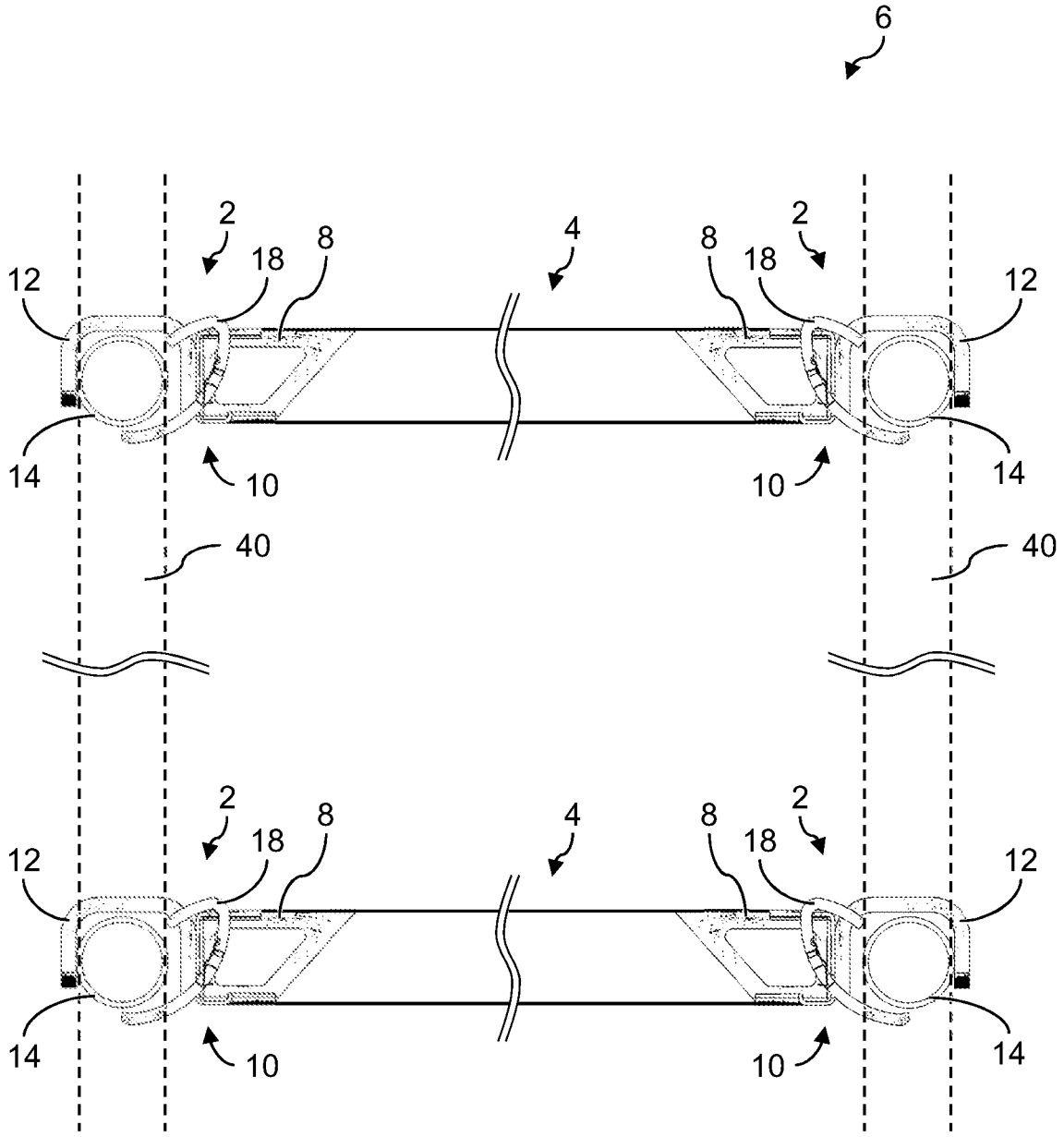

The figures show an example of an anti-lift system 2 for a floor part 4 for a scaffold 6. The system 2 comprises an end piece 8 configured to form a longitudinal end 10 of a floor part 4 for a scaffold 6, provided with one or more hook elements 12 with which the floor part 4 at the longitudinal end 10 can be hooked to a transverse ledger 14 of the scaffold 6 so as to be supported on that transverse ledger 14. The hook elements 12 define a ledger receiving space 16 for the transverse ledger 14. The transverse ledger 14 is received in the ledger receiving space 16 when the floor part 4 is hooked with the hook elements 12 to the transverse ledger 14.

FIG. 1 further shows two mutually identically configured floor parts 4 for a scaffold 6, each provided with two specimens of the anti-lift system 2, where the end piece 8 of each anti-lift system 2 forms a respective longitudinal end 10 of the respective floor part 4.

FIG. 1 further shows a scaffold 6 provided with the two floor parts 4, where each floor part 4 at the longitudinal ends 10 is hooked with its hook elements 12 to a respective transverse ledger 14 of the scaffold 6 so that the transverse ledger 14 is received in the ledger receiving space 16. In the example shown, transverse ledgers 14 located above each other are mutually connected by standards 40 of the scaffold 6.

The system 2 comprises a stiff bolt 18 couplable with the end piece 8, which, in coupled condition, is movable relative to the end piece 8 along a bolt movement path P, between a releasing position and a locking position. FIGS. 1, 2A, 3A, 4A, 5A and 5F show the bolt 18 of the example shown in the locking position. FIGS. 2B, 3B, 4B and 7 show the bolt 18 of the example shown in the releasing position.

In embodiments, the bolt 18 in coupled condition is manually operable both from an upper side of the floor part 4 and from an underside of the floor part 4, in particular both from the releasing position to the locking position and vice versa. Thus, the anti-lift system 2 can be operated as desired and/or depending on the situation by a user who is present, for instance, on the relevant floor part 4 itself or on a floor part 4 below that or on a base ground of the scaffold 6.

In the locking position, the bolt 18 extends along the ledger receiving space 16 to block movement of a received transverse ledger 14 out of the ledger receiving space 16. In the releasing position, the bolt 18 extends less, or does not extend, along the ledger receiving space 16 to release (unblock) movement of the received transverse ledger 14 out of the ledger receiving space 16.

In FIGS. 5B-E, it can be seen that between the locking position and the releasing position, various intermediate positions of the bolt 18 are possible.

According to claim 1, the anti-lift system 2 is configured to have the bolt 18, in coupled condition, automatically move to the locking position when the bolt 18 is between the locking position and the releasing position, at least when the transverse ledger 14 is received in the ledger receiving space 16.

During use, the bolt 18 can thus be automatically moved to the locking position when the bolt 18 is between the locking position and the releasing position. As set out in the summary hereinabove, the anti-lift protection is thereby rendered more reliable and easier to use.

In embodiments, the anti-lift system 2 is configured to have the bolt 18 in coupled condition automatically move to the locking position under its own weight when the bolt 18 is between the locking position and the releasing position, at least when the transverse ledger 14 is received in the ledger receiving space 16.

Thus, the automatic moving of the bolt 18 can be realized in a particularly robust manner, using the fact that the orientation of the floor part 4 and hence the relative direction of gravity during normal use is known in advance. To that end, the locking position, during normal use, preferably has a lower level than the releasing position, at least as regards a mass center of the bolt 18, as can be understood from the example shown.

It will be clear that the orientation of the bolt 18 in the locking position could nonetheless be different with respect to the releasing position. In the depicted example, such an orientation change is substantially achieved by an opening 24 through which the bolt 18 extends and an underside of which works as a guide to at least partly convert a downward force of gravity exerted on the bolt 18 into an orientation change of the bolt 18, in particular in combination with a further opening 22 which counteracts a sideward movement of the bolt 18 at that opening 22. Such openings 22, 24 may thus be regarded together as a converting and guiding mechanism that is configured to convert a downward force on the bolt 18 into a guided orientation and/or position change of the bolt 18. More generally, the system 2 preferably comprises such a converting and guiding mechanism, with the advantage that the automatic moving to the locking position under the influence of gravity can be combined with an at least partly sideward locking movement of the bolt 18 along an underside of the ledger receiving space 16, which underside is normally left open by the hook elements 12. The converting and guiding mechanism can advantageously define the bolt movement path P, which can thus extend at least partly sideways.

In embodiments, the bolt 18, at least a main section 20 thereof, extends in circular-arcuate form along a circular arc which in the coupled condition corresponds to the bolt movement path P.

In contrast to other types of curves, a circular arc has a same curvature at any position along the curve. This makes it possible to have the main section 20 extend consistently in accordance with the same bolt movement path P at different positions of the bolt 18 along the bolt movement path P. Thus, in a relatively simple manner, an effective guiding of the bolt 18 between the releasing position and the locking position can be provided, whereby in particular the openings 22, 24 mentioned can work together with the main section 20 to provide the guiding. Alternatively, the main section 20 of the bolt 18 could possibly extend rectilinearly, since a straight line also has a constant (viz., zero) curvature along its length. More generally, however, a nonzero curvature of the main section 20 has as an advantage that a substantially sideward bolt movement along the ledger receiving space 16 can be effectively and compactly combined with a substantially up-and-down bolt movement at the upper side 26 of the end piece 8 and floor part 4.

In embodiments, the bolt movement path P is defined by openings 22, 24 in the end piece 8, including a first opening 22 in an upper side 26 of the end piece 8 and a second opening 24 in a side 28 of the end piece 8 facing the ledger receiving space 16.

As has already been explained hereinabove, such openings 22, 24 can advantageously form a converting and guiding mechanism for the bolt 18. By providing the openings 22, 24 in the end piece 8, a separate guiding structure can be dispensed with, so that a relatively simple and compact construction of the system 2 is possible. By providing the first opening 22 in the upper side 26, a portion of the bolt 18 can extend at and/or above that upper side 26 for easy operation of the bolt 18 from above. By providing the second opening 24 in the side 28 facing the ledger receiving space 16, a portion of the bolt 18 can extend at the ledger receiving space 16, at least in the locking position.

In embodiments, the bolt 18 extends between a blocking end 30 and an operating end 32, with the blocking end 30 in the coupled condition being movable along the ledger receiving space 16 by moving the bolt 18 along the bolt movement path P between the locking position and the releasing position.

Figure 2A:
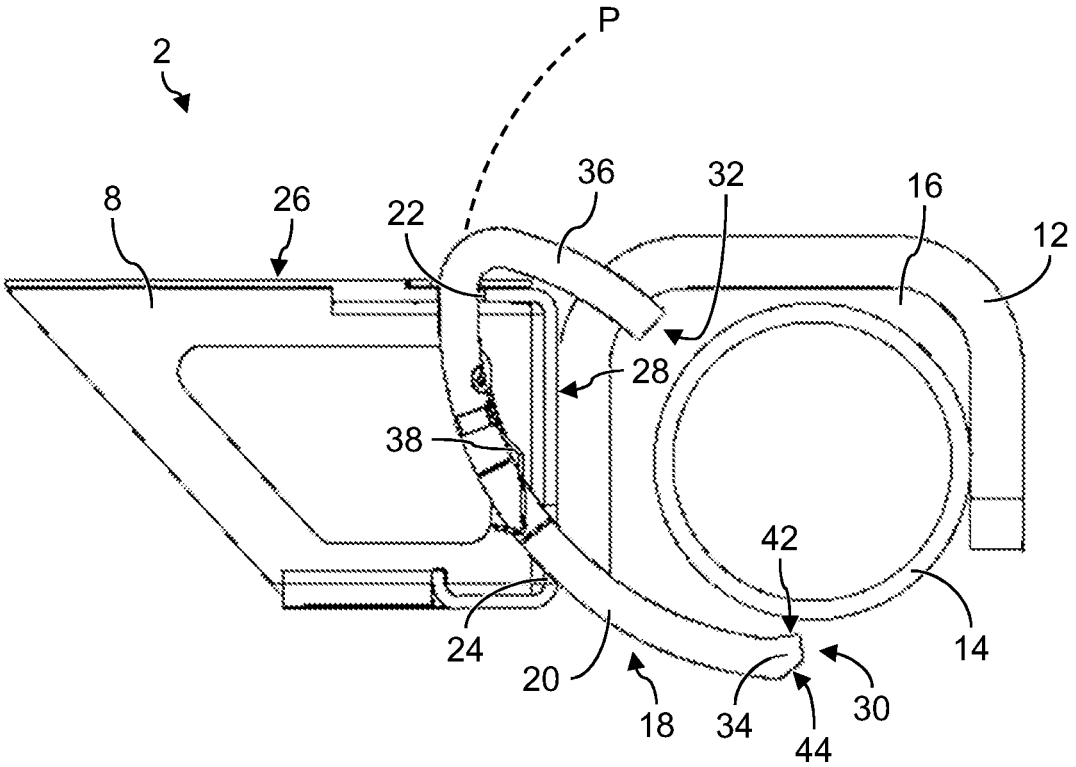
Figure 2B:
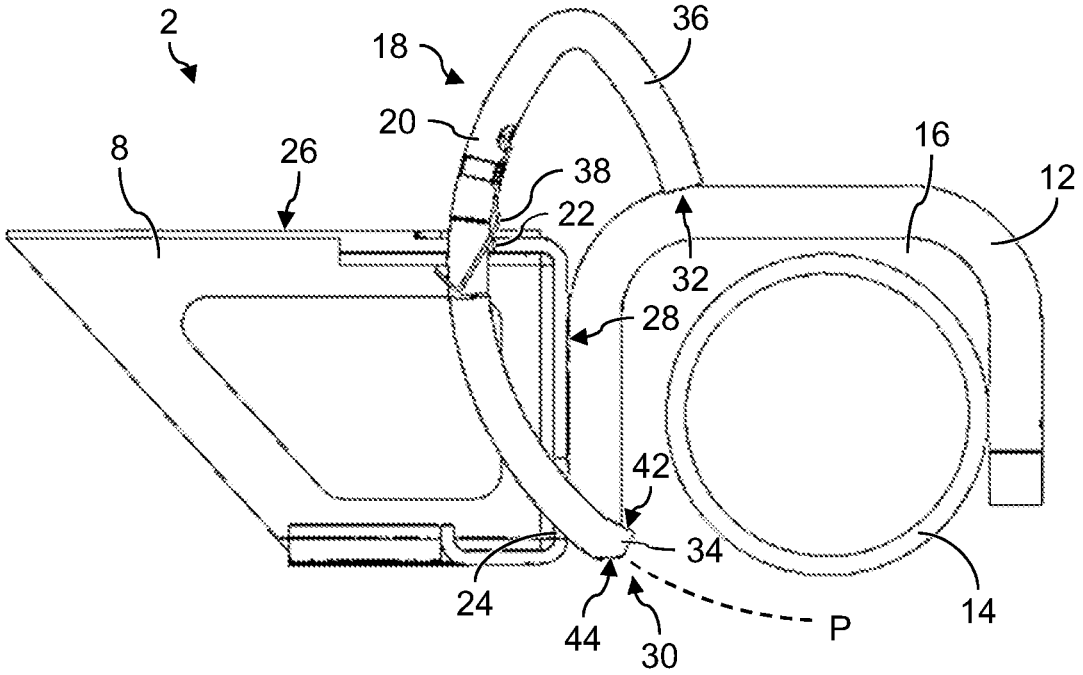
Figure 3A:
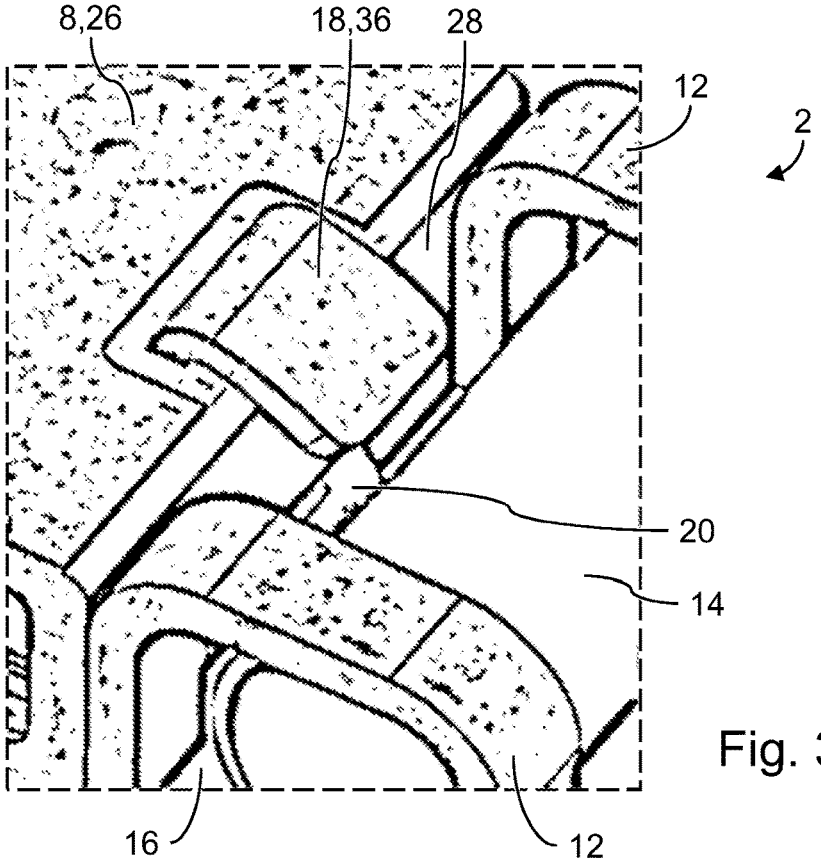
Figure 3B:
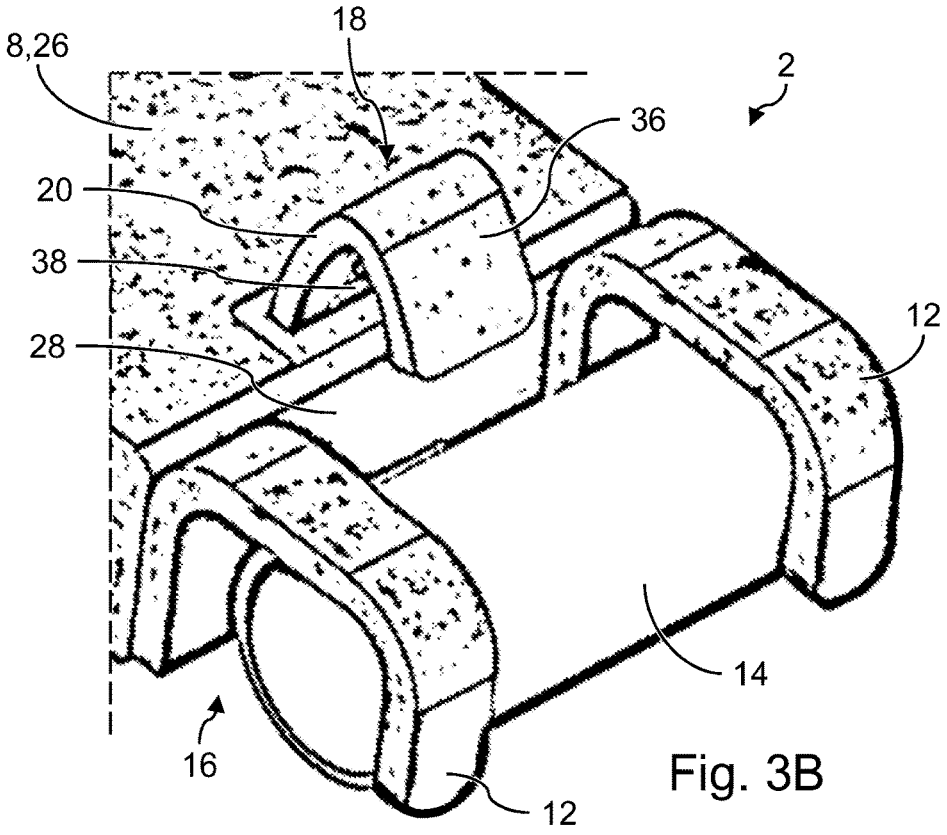
Figure 4A:
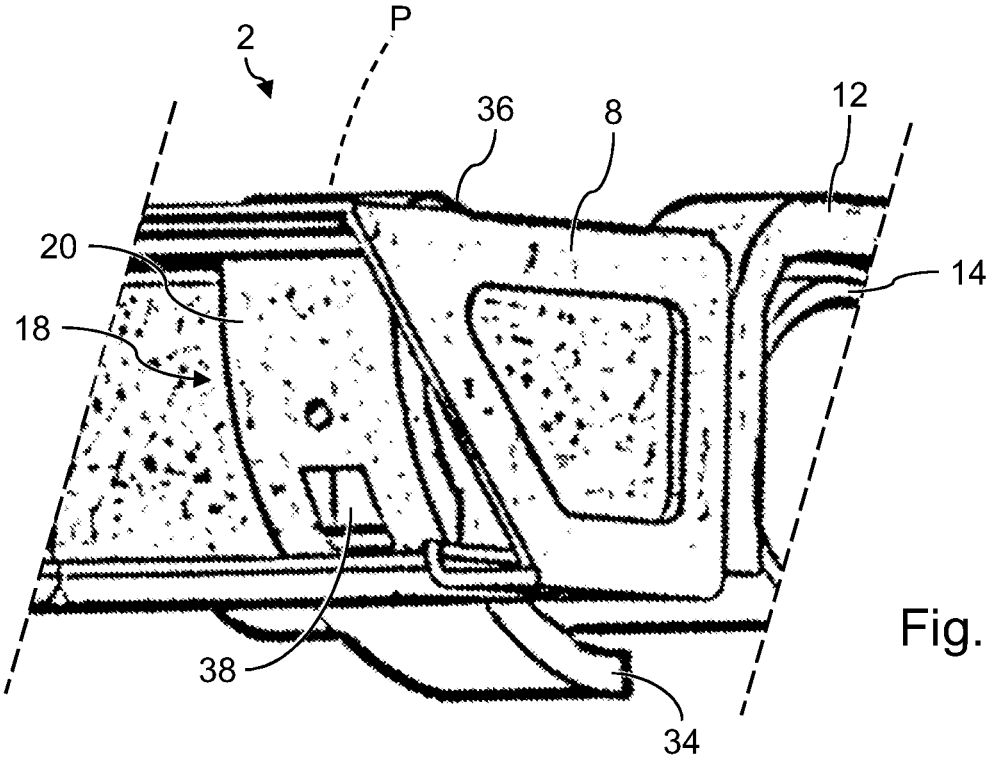
Figure 4B:
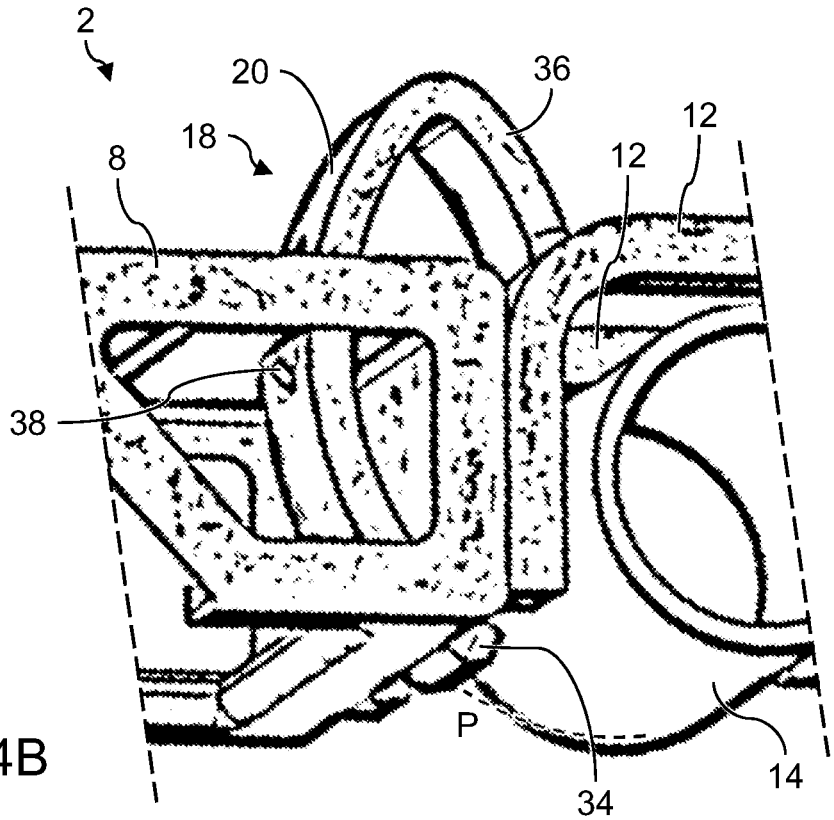

The blocking end 30 can thus, together with ends of the hook elements 12, determine a size of a passage from and to the ledger receiving space 16, such opening, with respect to the diameter of transverse ledger 14, being narrow when the bolt 18 is in the locking condition and wide when the bolt 18 is in the releasing position, as can be seen, for instance, in FIGS. 2A-B.

In embodiments, the operating end 32 in the coupled condition is at and/or above an upper side 26 of the end piece 8 so as to be accessible at that upper side 26 for operation, in particular both in the locking position and in the releasing position.

Thus, a user who is present on the relevant floor part 4 can operate the bolt 18 relatively easily, for instance by foot or by hand. For that matter, the bolt 18 is preferably operable from below as well, as has been mentioned elsewhere herein. Operation from below can for instance be done by moving the main section 20 and/or the blocking end 30 by hand along the bolt movement path P, for instance from an underside of the ledger receiving space 16 and/or from an inner side of the end piece 8.

In embodiments, the bolt 18 comprises at the blocking end 30 a blocking end section 34 which extends inwards with respect to the circular-arcuate form of the main section 20.

This can effectively counteract the bolt 18 being moved out of the locking position by a transverse ledger 14 present in the ledger receiving space 16 in case of an upward force on the floor part 4, for instance by wind, while at the same time the distance between the locking position and the releasing position along the path P can be relatively short for an easy-to-operate and compact system 2. Due to the inwards extending blocking end section 34, such an upward force on the floor part 4 will actually lead advantageously to the bolt 18 getting itself in a clamping manner fixed in the locking position. More generally, the above-mentioned unwanted-movement prevention and the clamped fixation of the bolt 18 can be achieved in that, at the blocking end 30, on the inner side of the arcuate form of the bolt, a contact surface 42 for contact with the transverse ledger 14 is provided, which contact surface 42 has a normal direction corresponding to a direction of movement of the bolt 18 from the locking position to the releasing position. When the transverse ledger 14, as a result of the upward force on the floor part 4, comes into contact with that contact surface 42, the force exerted by the transverse ledger 14 on the bolt 18 is directed by the normal direction, such that the bolt 18 is fixed in the locking position, in particular when the system 2, as in the example shown, is configured to counteract movement beyond the locking position.

Alternatively to or additionally to the feature of the blocking end section 34 extending inwards relative to the arcuate form, a length of the main section 20 of the bolt 18 may be increased with respect to the example shown, such that, as a result, the bolt 18 in the locking position extends at least partly upwards at the blocking end 30. Further, it is alternatively or additionally possible that on the bolt 18, at the blocking end 30, on the inner side of the arcuate form, a thickening is provided which is formed to provide the contact surface with normal direction.

In the example shown, the blocking end section 34 is relatively short, in particular having a length in the same order of magnitude as the thickness of the bolt 18. Nonetheless it can be seen, for instance in FIG. 2B, that the blocking end section 34 extends slightly inwards with respect to the circular-arcuate form of the main section 20 and the bolt movement path P.

In embodiments, the bolt 18 comprises at the operating end 32 an operating end section 36 which extends inwards with respect to the circular-arcuate form of the main section 20.

In this way, the operating end 32 and/or the operating end section 36 can be particularly easily accessible for operation by a user. The operating end section 36 preferably extends beyond an end of the end piece 8 which is here formed by the side 28 of end piece 8 facing the ledger receiving space 16, in particular in the locking position, so that manual engagement of the operating end 32 is not hindered by the end piece 8. The operating end section 36 can thus form a lug which, in the locking position, can be engaged by a user, as can for instance be seen in FIG. 3A.

When the operating end section 36, more generally, extends in a deviating manner compared with the main section 20, it can additionally be counteracted that the operating end section 36 can move downwards through the opening 22 when the bolt 18 is being moved along the bolt movement path P, so that it can be counteracted that the bolt moves from the releasing position beyond the locking position. Thus, it holds that, in embodiments, the operating end 32 is formed so as, by interaction with the end piece 8, in particular with the upper side 26 in which the opening 22 is formed, to counteract the bolt 18 being moved from the releasing position beyond the blocking position.

In embodiments, the operating end section 36 extends from the main section 20 toward the ledger receiving space 16, in particular in the locking position.

In this way, it is made possible that the bolt 18 in the locking position constitutes practically no obstacle at the upper side 26 of the end piece 8, so that in the locking position a relatively even and unhindered walking surface of the floor part 4 can be provided, while the operating end 32 can yet remain properly accessible for operation.

In embodiments, the operating end section 36 in the releasing position extends downwards in order for a part of the main section 20 extending above the upper side 26 of the end piece 8 to be screened on an inner side of the circular-arcuate form from contact with a foot of a user.

In itself, foot contact with the bolt 18 in the releasing position is not unwanted. On the contrary: in embodiments as in the example shown, the bolt 18 is formed to be operable by such foot contact in order to move the bolt 18 from the releasing position to the locking position. Such foot contact can for instance be substantially downwardly directed, but may also be directed more sideways, while a relevant contact surface of the bolt 18 can have a bevel which allows the sideward foot contact to be converted into a downward movement of the bolt 18. Foot contact with the inner side of the circular-arcuate form of the main section 20, however, is unwanted, not only because this would not contribute to the bolt moving to the locking position, but also because the foot might then get caught on the arcuate form. The above-mentioned screening by the operating end section 36 offers in this context, in particular in combination with the circular-arcuate form of the main section 20, a simple and robust solution, which, moreover, as regards the arrangement of operating end section 36, can be well combined with one or more other functions of the operating end section 36 such as the above-mentioned operation of the bolt 18 from the locking position to the releasing position.

According to the invention, the system 2 further comprises a resistance element 38 configured to provide a resilient resistance to counteract movement of the coupled bolt 18 from the releasing position to the locking position so as to at least selectively stabilize the releasing position, wherein the resilient resistance can be overcome when the bolt 18 is actively moved to the locking position by a user by hand or by foot.

In this way, the bolt 18, if desired, can be held in the releasing position without continuous operation, so that the floor part 4 can be taken off the transverse ledger 14, for instance in the event of disassembly or adaptation of the scaffold 6. The resistance element 38 is preferably configured to counteract the movement to the locking position only at the releasing position. This is to say that when the bolt 18 has been moved from the releasing position to some extent toward the locking position, for instance through active operation by a user, the resistance element 38 preferably does not counteract further movement of the bolt 18 to the locking position, so that the bolt 18 can for instance reach the locking position under its own weight as described elsewhere herein.

In embodiments, the resistance element 38 comprises a leaf spring. In embodiments, the resistance element 38 is made of spring steel.

Figure 7:
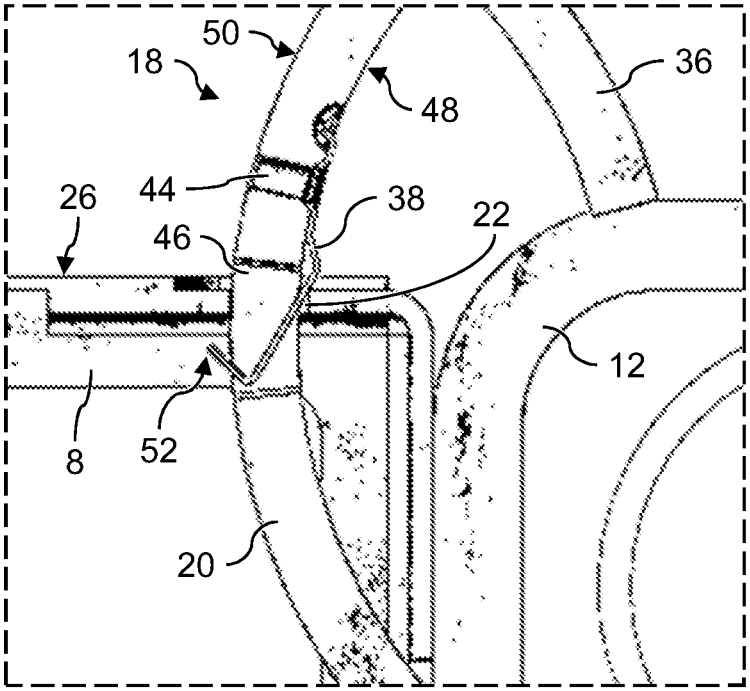
FIG. 7 shows a detail of FIG. 2B.

Thus, the resistance element 38 can be realized in a relatively simple yet effective manner. In FIG. 7, the resistance element 38 shown in the example can be seen particularly well. The resistance element 38 is formed here, and may be formed so more generally, as a folded strip of spring steel which, with a fastener 44 such as a fastening bolt or a nail, is attached to the bolt 18, and which extends from the fastener 44 as a leaf spring downwards along and spaced from an inner side 48 of the bolt 18 and through an opening 46 in the bolt 18 to outside an outer side 50 of the bolt 18.

More generally, it holds that, in embodiments, the resistance element 38 is fixedly connected with one of the bolt 18 and the end piece 8, and is configured for engagement with the other one of the bolt 18 and the end piece 8, depending on the position of the bolt 18 with respect to the end piece 8. In this way, therefore, it is for instance possible, as an alternative to the resistance element 38 shown in FIG. 7 and fixedly connected with the bolt 18, that the resistance element is fixedly connected with the end piece 8, for instance at the opening 22.

In the situation shown in FIG. 7, the resistance element 38, in particular the portion extending along and spaced from the inner side 48 of the bolt 18, gives resilient resistance to moving down of the bolt 18, in particular through interaction with an edge of the opening 22. When a user actively moves the bolt 18 down, that resistance can be overcome, whereby the leaf spring of the resistance element 38 is deformed so as to pass through the opening 22, whereby in particular the above-mentioned distance between the leaf spring and the inner side 48 of the bolt 18 is reduced or is even removed. While not necessarily desired, a comparable working of the resistance element 38 may find application when the bolt 18 is moved in the opposite direction from the locking position to the releasing position, for instance by a user: the resistance element 38, then too, gives a resilient resistance upon passage of the opening 22 in the upper side 26 of the end piece 8. Such resistance can for instance provide haptic feedback. Furthermore, such a resistance can help counteract the bolt 18 being unintendedly brought into the releasing position, for instance when hooking the floor part 4 to the transverse ledger 14.

In embodiments, the system 2, in particular the resistance element 38, is configured so as, in the coupled condition, to counteract uncoupling of the bolt 18 with respect to the end piece 8.

Figure 8:
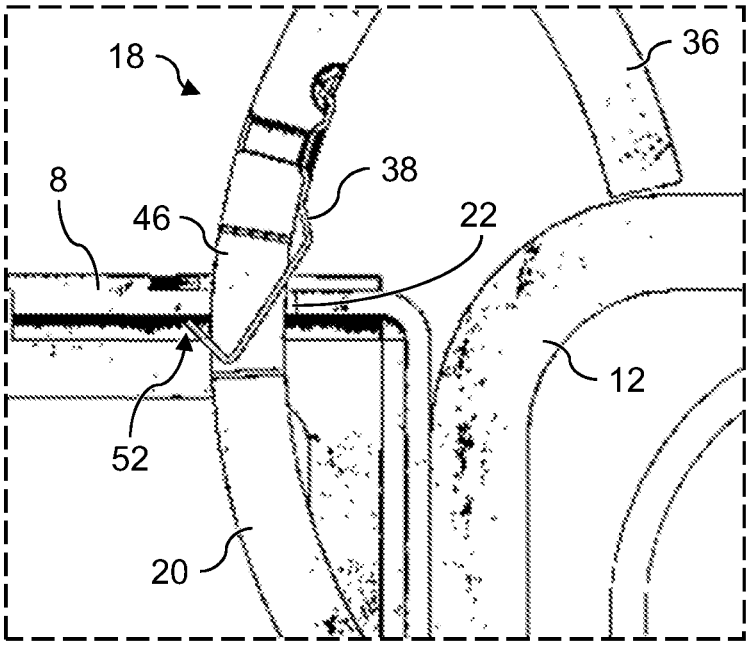
FIG. 8 shows a detail according to FIG. 7, wherein the bolt, compared with FIG. 7, has been moved up slightly.

In FIG. 8, it can be seen, by way of example, that an end 52 of the resistance element 38 counteracts such uncoupling, by engagement with an inner side of the end piece 8 at the opening 22, as a result of which the bolt 18, from the releasing position, can normally be hardly, if at all, moved up any further. In this way, unintended uncoupling can be counteracted.

Possibly, uncoupling of the bolt 18 can, if desired, be made possible still, in particular by moving the end 52 by hand into the opening 46. In this way, the bolt 18 can for instance be easily replaced or cleaned.

Figure 6A:
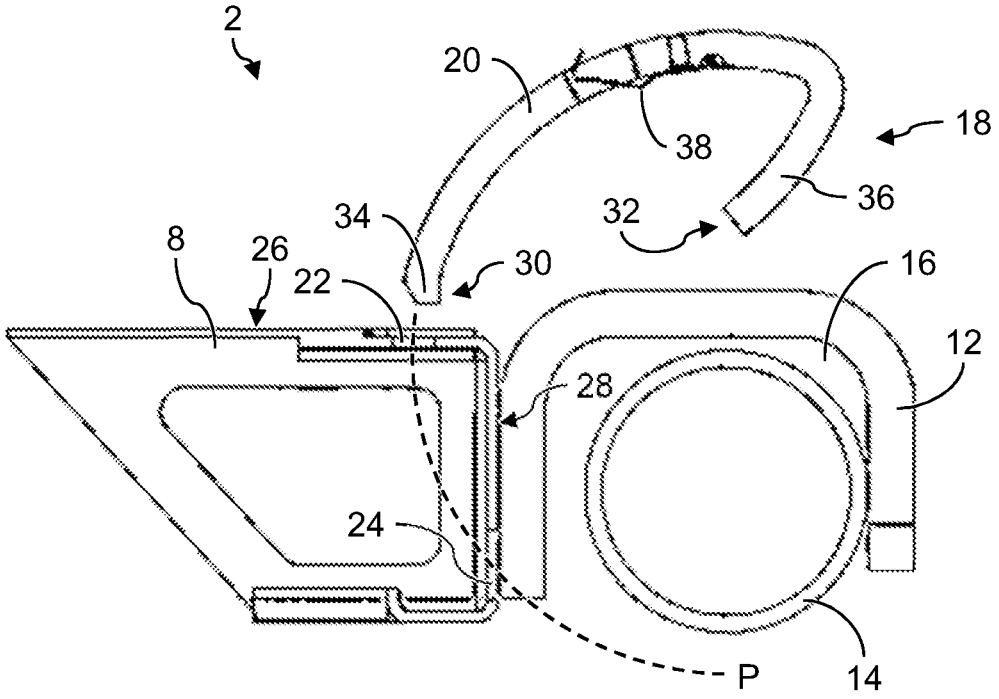
Figure 6B:
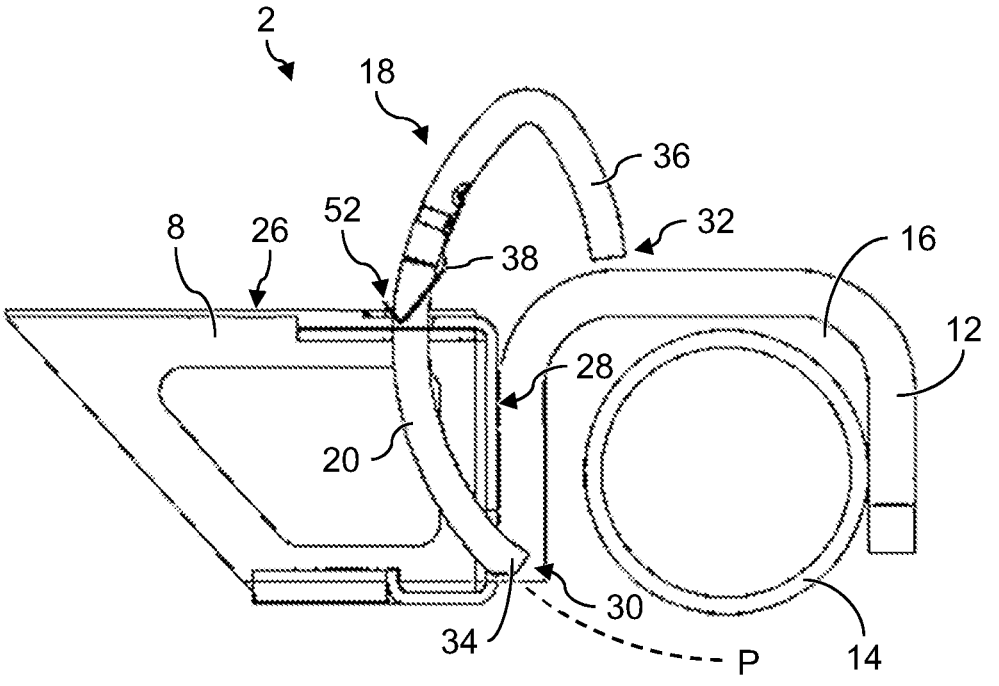

In the example shown, the resistance element 38 is so configured that coupling (for instance a first coupling as an assembly step, and/or a recoupling after maintenance) of the bolt 18 to the end piece 8 is not counteracted, at least not more than by a resilient resistance that can be overcome by a user by actively moving the bolt 18 down. In FIG. 6A it can be seen that the bolt 18 upon such a coupling can be moved from above through the opening 22, then proceed to follow the bolt movement path P, whereby the resistance element 38, in particular a portion at the end 52, can give some resilient resistance in the situation as shown in FIG. 6B. After that resistance has been overcome, the bolt 18 is effectively in the releasing position coupled to the end piece 8. More generally, FIGS. 6A and 6B show in this way that coupling of the bolt 18 can be particularly easy, while the resistance element 38, for instance, may already have been assembled to the bolt 18 beforehand.

In embodiments, the bolt 18 is coupled with the end piece 8. Such a coupling is preferably detachable, for instance as set out hereinabove, but may also be a fixed coupling. When the bolt 18 is coupled with the end piece 8, the system 2 is ready for use, at least in embodiments including the example shown. Moreover, in this way, the bolt 18 can be easily kept with the floor part 4, for instance during transport.

In embodiments, the bolt 18 in the coupled condition is configured to be moved from the locking position toward the releasing position by interaction with the transverse ledger 14 when the floor part 4 is being hooked with the hook elements 12 to the transverse ledger 14, such that the transverse ledger 14 during hooking-on can be received in the ledger receiving space 16 without operation of the bolt 18.

In this way, ease of use of the system 2 can be considerably increased. Preferably, the releasing position itself is therewith almost but not quite reached, so that the bolt 18 can then automatically move to the locking position when the transverse ledger 14 has been received in the ledger receiving space 16. As an alternative, possibly, the releasing position might in fact be reached, so that thereupon a manual operation may be needed to have the bolt return to the locking position.

In FIGS. 5A-D, it is stepwise shown how the bolt 18 can thus be moved from the locking position toward the releasing position. The releasing position itself is therewith nearly but not quite reached (see FIG. 5D, for instance compared with FIG. 2B where the releasing position is shown), due to the transverse ledger 14 being able to enter the ledger receiving space 16 just before the releasing position would be reached, and possibly due to the resistance element 38 giving some resilient resistance to the reaching of the releasing position, as explained elsewhere herein.

Unlike what happens preferably in the releasing position itself, the resistance element 38 here does not counteract movement of the bolt 18 to the locking position, so that the bolt 18, as mentioned, can automatically move to the locking position after the floor part 4 has been hooked with the hook elements 12 to the transverse ledger 14.

Figure 5A:
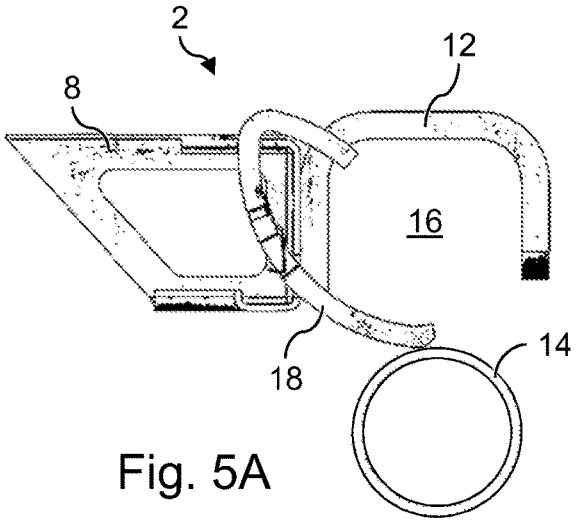
Figure 5B:
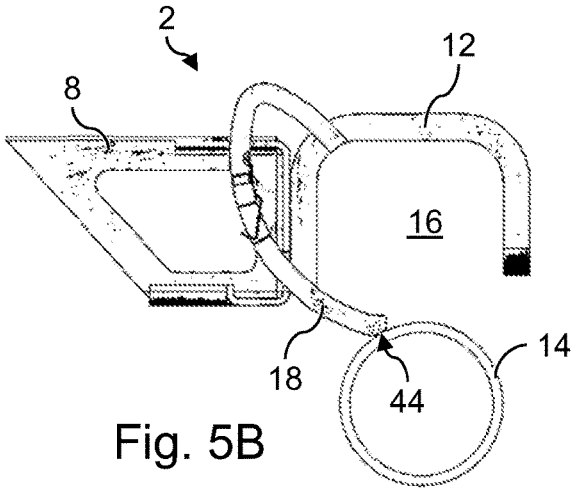
Figure 5C:
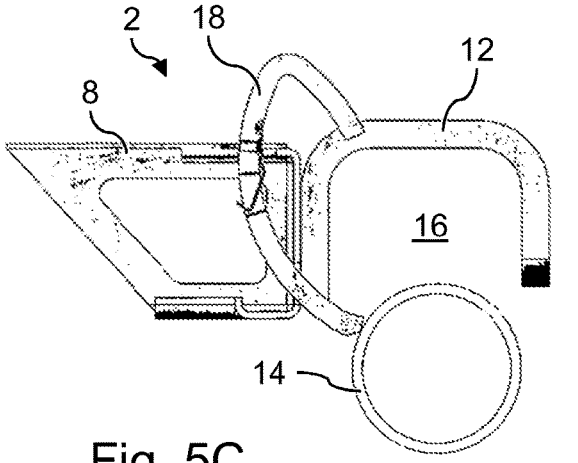
Figure 5D:
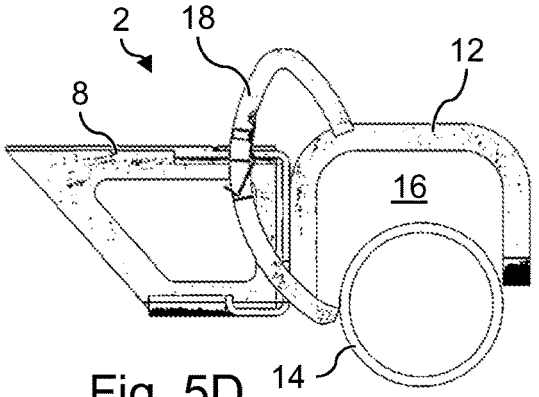

While the position of the bolt 18 shown in FIG. 5D, strictly speaking, could be regarded as a releasing position because movement of the transverse ledger 14 out of the ledger receiving space 16 in this position of the bolt is just possible, it will be clear that this position is yet unlike the releasing position as intended in the context of the present description, at least there where the present description refers to stabilizing of the releasing position using the resistance element 38. That stabilizable releasing position is preferably such that the transverse ledger 14 can exit the ledger receiving space 16 with some play or freedom of movement, hence unlike the position of FIG. 5D where the transverse ledger 14 makes contact with hook elements 12 on one side and the blocking end 30 of the bolt 18 on the other.

For that matter, the herein described possibilities with respect to moving the bolt 18 toward the releasing position by interaction with the transverse ledger 14 are advantageously applicable in a more general sense as well, possibly even without the anti-lift system being configured, as described, to have the bolt in coupled condition automatically move to the locking position when the bolt is between the locking position and the releasing position. Thus, the current disclosure furthermore comprises an anti-lift system according to claim 17. With such a system, ease of use and efficiency can be increased, in particular in that the bolt 18 does not counteract the floor part 4 being hooked with the hook elements to the transverse ledger 14, not even when the bolt 18 upon approach of the transverse ledger 14 is in the locking position.

In embodiments, the bolt 18, at the blocking end 30 thereof, is provided with a bevel or rounding on the outer side of the bolt 18, the bevel or rounding forming a guiding contact surface 44 (see FIGS. 2A-B and 5B) to guide the transverse ledger 14 and the blocking end 30 along each other when the floor part 4, as described hereinbefore, is being hooked with the hook elements 12 to the transverse ledger 14, as can be seen stepwise in FIGS. 5A-D.

Figure 5E:
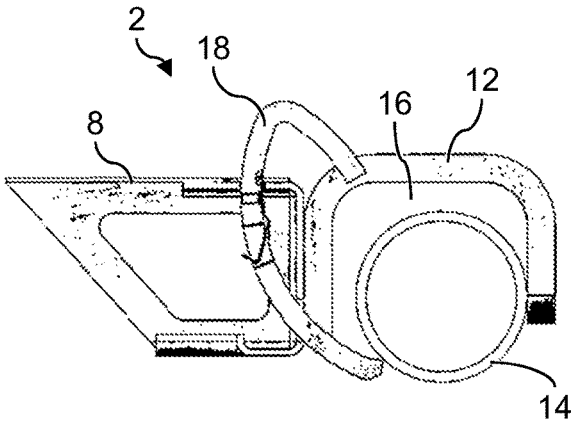
Figure 5F:
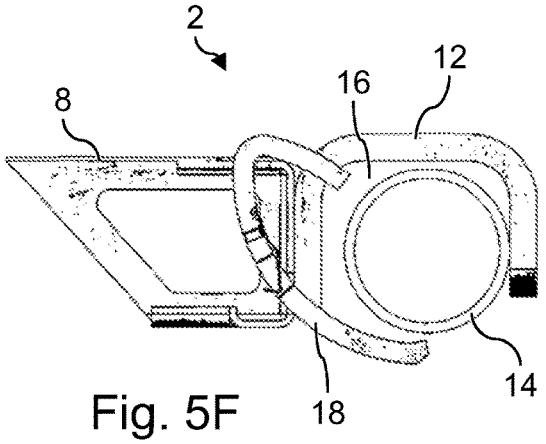

In FIGS. 5E-F it can be seen stepwise how the bolt 18 thereupon automatically moves back to the locking position as soon as the transverse ledger 14 has been received in the ledger receiving space 16, in particular under its own weight, as has been explained elsewhere herein.

While the invention has herein been explained on the basis of examples of embodiments and drawings, these do not constitute any limitation of the scope of the invention as defined with the claims. The skilled person will directly appreciate on the basis of the current disclosure that within that scope many variations, combinations and extensions are possible. Examples thereof have been mentioned in the description.

LIST OF REFERENCE SIGNS

2. Anti-lift system
4. Floor part
6. Scaffold
8. End piece
10. Longitudinal end of floor part
12. Hook element
14. Transverse ledger
16. Ledger receiving space
18. Bolt
20. Main section
22. First opening in end piece
24. Second opening in end piece
26. Upper side of end piece
28. Side of end piece facing ledger receiving space
30. Blocking end
32. Operating end
34. Blocking end section
36. Operating end section
38. Resistance element
40. Standard
42. Contact surface on inner side of bolt
44. Contact surface on outer side of bolt
46. Opening in bolt
48. Inner side of bolt
50. Outer side of bolt
52. End of resistance element
P. Bolt movement path

The invention claimed is:

1. An Anti-lift system for a floor part for a scaffold, comprising:

an end piece configured to form a longitudinal end of a floor part for a scaffold, provided with one or more hook elements with which the floor part at the longitudinal end can be hooked to a transverse ledger of the scaffold so as to be supported on that transverse ledger, wherein the hook elements define a ledger receiving space for the transverse ledger, in which ledger receiving space the transverse ledger is received when the floor part is hooked with the hook elements to the transverse ledger; and a stiff bolt couplable with the end piece, which in coupled condition is movable relative to the end piece along a bolt movement path between a releasing position and a locking position, wherein the bolt in the locking position extends along the ledger receiving space to block movement of a received transverse ledger out of the ledger receiving space, wherein the bolt in the releasing position extends less or not along the ledger receiving space to release movement of the received transverse ledger out of the ledger receiving space, wherein the anti-lift system is configured to have the bolt in coupled condition automatically move to the locking position when the bolt is between the locking position and the releasing position, at least when the transverse ledger is received in the ledger receiving space, wherein the anti-lift system further comprises a resistance element which is configured to provide a resilient resistance to counteract movement of the coupled bolt from the releasing position to the locking position so as to at least selectively stabilize the releasing position, wherein the resilient resistance can be overcome when the bolt is actively moved to the locking position by a user with a hand or a foot, wherein the resistance element comprises a leaf spring, wherein the bolt extends between a blocking end and an operating end, wherein the blocking end in the coupled condition is movable along the ledger receiving space by moving the bolt along the bolt movement path between the locking position and the releasing position, wherein the operating end in the coupled condition is at and/or above an upper side of the end piece so as to be accessible at that upper side for operation, both in the locking position and in the releasing position, wherein, in the coupled condition, both in the locking position and in the releasing position, the bolt extends between the blocking end and the operating end through an opening formed in the end piece at the upper side of the end piece, wherein the resistance element is fixedly connected with the bolt and configured for engagement with the end piece, wherein the resilient resistance to counteract movement of the coupled bolt from the releasing position to the locking position is provided by resilient engagement of a first portion of the resistance element with the end piece at the opening, wherein the resistance element is furthermore configured, in the coupled condition, to counteract uncoupling of the bolt with respect to the end piece by upward abutment of a second portion of the resistance element against the end piece, and wherein, both during the resilient engagement of the first portion with the end piece and during the abutment of the second portion against the end piece, the resistance element extends through the opening such that the first portion and the second portion are on mutually opposite sides of the opening.

2. The anti-lift system according to claim 1, wherein the bolt, at least a main section thereof, extends in circular-arcuate form along a circular arc which in the coupled condition corresponds to the bolt movement path.

3. The anti-lift system according to claim 1, wherein the bolt movement path is defined by openings in the end piece including a first opening in an upper side of the end piece and a second opening in a side of the end piece facing the ledger receiving space.

4. The anti-lift system according to claim 1, wherein the operating end is formed so as, by interaction with the end piece, to counteract the bolt being moved from the releasing position beyond the blocking position.

5. The anti-lift system according to claim 1, wherein the resistance element is made of spring steel.

6. The anti-lift system according to claim 1, wherein the resistance element is formed as a folded strip of spring steel, which is attached to the bolt with a fastener such as a fastening bolt or a nail, and which extends from the fastener as a leaf spring downwards along and spaced from an inner side of the bolt and through an opening in the bolt to outside of an outer side of the bolt.

7. The anti-lift system according to claim 1, wherein the resistance element is configured to counteract the movement to the locking position only at the releasing position.

8. The anti-lift system according to claim 1, wherein the anti-lift system is configured to have the bolt in coupled condition automatically move under its own weight to the locking position when the bolt is between the locking position and the releasing position, at least when the transverse ledger is received in the ledger receiving space.

9. The anti-lift system according to claim 1, wherein the bolt in the coupled condition is configured to be moved from the locking position toward the releasing position, preferably close to but not into the releasing position, by interaction with the transverse ledger when the floor par is being hooked with the hook elements to the transverse ledger, such that the transverse ledger during hooking-on can be received in the ledger receiving space without operation of the bolt.

10. The anti-lift system according to claim 1, wherein the bolt is coupled with the end piece.

11. A floor part for a scaffold, provided with at least one anti-lift system according to claim 1, wherein the end piece of each anti-lift system forms a respective longitudinal end of the floor part.

12. Use of the anti-lift system according to claim 1 for anti-lift protection of a floor part which at a longitudinal end of the floor part is hooked with hook elements to a transverse ledger of a scaffold, so that the transverse ledger is received in the ledger receiving space, wherein the bolt is coupled with the end piece and is preferably automatically moved to the locking position when the bolt is between the locking position and the releasing position.

13. The anti-lift system according to claim 2, wherein the bolt at the blocking end comprises a blocking end section which extends inwards with respect to the circular-arcuate form of the main section.

14. The anti-lift system according to claim 2, wherein the bolt at the operating end comprises an operating end section which extends inwards with respect to the circular-arcuate form of the main section.

15. The anti-lift system according to claim 14, wherein the operating end section extends from the main section toward the ledger receiving space.

16. The anti-lift system according to claim 14, wherein the operating end section in the releasing position extends downwards to screen a part of the main section extending above the upper side of the end piece on an inner side of the circular-arcuate form from contact with a foot of a user.

17. The floor part according to claim 11, wherein the bolt in coupled condition is manually operable both from an upper side of the floor part and from an underside of the floor part.

18. A scaffold provided with the floor part according to claim 11, wherein the floor part at the longitudinal end is hooked with the hook elements to a respective transverse ledger of the scaffold, so that the transverse ledger is received in the ledger receiving space.

* * * * *